US006647839B2

(12) United States Patent
Yoshitome et al.

(10) Patent No.: US 6,647,839 B2
(45) Date of Patent: Nov. 18, 2003

(54) METHOD OF FORMING AN INTEGRAL TUBULAR PROJECTION IN A WORK BY SPINNING AND A PRODUCT PRODUCED BY THE SAME

(75) Inventors: Masaaki Yoshitome, Kanagawa (JP); Masayuki Suzuki, Kanagawa (JP)

(73) Assignee: Nissan Motor Co., Ltd., Kanagawa (JP)

( * ) Notice: Subject to any disclaimer, the term of this patent is extended or adjusted under 35 U.S.C. 154(b) by 0 days.

(21) Appl. No.: 09/801,767

(22) Filed: Mar. 9, 2001

(65) Prior Publication Data

US 2001/0039864 A1 Nov. 15, 2001

(30) Foreign Application Priority Data

Mar. 14, 2000 (JP) ..... 2000-069945
Nov. 22, 2000 (JP) ..... 2000-355288

(51) Int. Cl.[7] ..... B21D 53/26
(52) U.S. Cl. ..... 82/1.11; 72/71
(58) Field of Search ..... 82/1.11, 47, 103, 82/104, 105, 106, 112, 113, 117; 72/71, 84, 85, 110

(56) References Cited

U.S. PATENT DOCUMENTS 5,823,904 A * 10/1998 Hodjat et al. ..... 29/892
5,829,291 A * 11/1998 Tanaka et al. ..... 72/110
5,951,422 A * 9/1999 Roes et al. ..... 474/94
6,105,410 A * 8/2000 Sauberlich et al. .... 29/894.362
6,427,329 B2 * 8/2002 Monahan et al. ..... 29/892

FOREIGN PATENT DOCUMENTS

| | | |
|---|---|---|
| DE | 4444526 C1 * | 11/1995 |
| DE | 197 06 466 | 8/1998 |
| EP | 0 815 983 | 1/1998 |
| JP | 9-506295 | 6/1997 |
| WO | 98/18582 | 5/1998 |

* cited by examiner

*Primary Examiner*—Daniel W. Howell
(74) *Attorney, Agent, or Firm*—McDermott, Will & Emery

(57) ABSTRACT

A method of forming an integral tubular projection in a disk-shaped work by spinning is provided. In the method, h=0.1 to 0.5t, d=0.25 to 0.94D, T=0.5 to 7h, and $V=0.029$ to $0.234\pi D^2h$ where h is a depth by which a forming roller cuts into the work, t is a thickness of the work, d is an outer diameter of the tubular projection, D is a diameter of a circle including a point where the spinning by the forming roller starts, T is a thickness of a wall of the tubular projection, and V is a volume of the tubular projection. A product produced by the above method is also provided.

15 Claims, 8 Drawing Sheets

METHOD OF FORMING AN INTEGRAL TUBULAR PROJECTION IN A WORK BY SPINNING AND A PRODUCT PRODUCED BY THE SAME

BACKGROUND OF THE INVENTION

The present invention relates in general to a spinning process which is one of plastic working processes and more specifically to a method of forming an integral tubular projection which is shaped like a boss, in a disk-shaped work by spinning.

An example of this kind of plastic working or spinning process is disclosed in Japanese Patent Provisional Publication No. 9-506295.

SUMMARY OF THE INVENTION

The prior art spinning process is adapted to form a boss of a part by collecting a material of a work around a pin gradually by shear spinning and pushing it into a space defined by an upper surface of a lower jig, a lower surface of an upper pressure jig and an outer circumferential surface of the pin integral with the lower die, namely, materially by the full closed die forging technique. Accordingly, the inner and outer diameters of the boss of the formed part are determined depending upon the diameter of the pin.

A problem of the prior art spinning process is that unless the lower jig is replaced by one having a pin of a different size, a part having a boss of a different inner diameter cannot be produced. Another problem is that it is necessary that a work is previously formed with a hole into which the above described pin is to be inserted. The problems inevitably increase the number of necessary process steps and therefore the manufacturing cost.

It is accordingly an object of the present invention to provide a spinning process which can form a hollow cylindrical projection or boss of a desired inner diameter in a work with ease and without being restricted by the size of the above described pin and without requiring a prepared hole in the work.

To accomplish the object, there is provided according to an aspect of the present invention a method of forming an integral tubular projection in a disk-shaped work, the work having a flat plate portion, the method comprising: driving the work to rotate in such a manner that the flat plate portion is held positioned on a plane; spinning the work by using a forming roller whose axis is inclined to form a predetermined angle with an axis of rotation of the work, in such a manner as to cause a section of the work to decrease in thickness and another section of the work to increase in thickness and grow to the tubular projection;

wherein:

$h=0.1$ to $0.5t$;

$d=0.25$ to $0.94D$;

$T=0.5$ to $7h$;

$V=0.029$ to $0.234\pi D^2h$;

where h is a depth by which the forming roller cuts into the work, t is a thickness of the work, d is an outer diameter of the tubular projection, D is a diameter of a circle including a point where the spinning by the forming roller starts, T is a thickness of a wall of the tubular projection, and V is a volume of the tubular projection.

According to another aspect of the present invention, there is provided a method of forming an integral tubular projection in a disk-shaped work by spinning, comprising:

forming the work into a shallow dish shape, the shallow dish-shaped work having an inclined wall portion other than a flat central portion where the projection is to be formed; supporting the shallow dish-shaped work on a mandrel shaped correspondingly to the shallow dish-shaped work; rotating the shallow dish-shaped work about an axis thereof together with the mandrel; pushing a forming roller against the inclined wall portion of the work while moving the roller along the inclined wall portion of the work and thereby causing the inclined wall portion to partially decrease in thickness and the central portion to partially increase in thickness and grow to the tubular projection.

According to a further aspect of the present invention, there is provided a method of forming a disk-shaped part having an integral, concentric boss in the form of a hollow cylindrical projection, by spinning, comprising: preparing a work in the form of a flat circular plate; holding the work between a mandrel and a tail stock and driving the work to rotate; pushing a forming roller against the work and thereby causing a radially outer section of the work to decrease in thickness and a radially inner section of the work to increase in thickness and grow to the boss while holding an inner circumferential surface of the projection apart from an outer circumferential surface of the tail stock.

According to a further aspect of the present invention, there is provided a product which is produced by either of the above described methods of the present invention.

DESCRIPTION OF THE PREFERRED EMBODIMENTS

Figure 1:
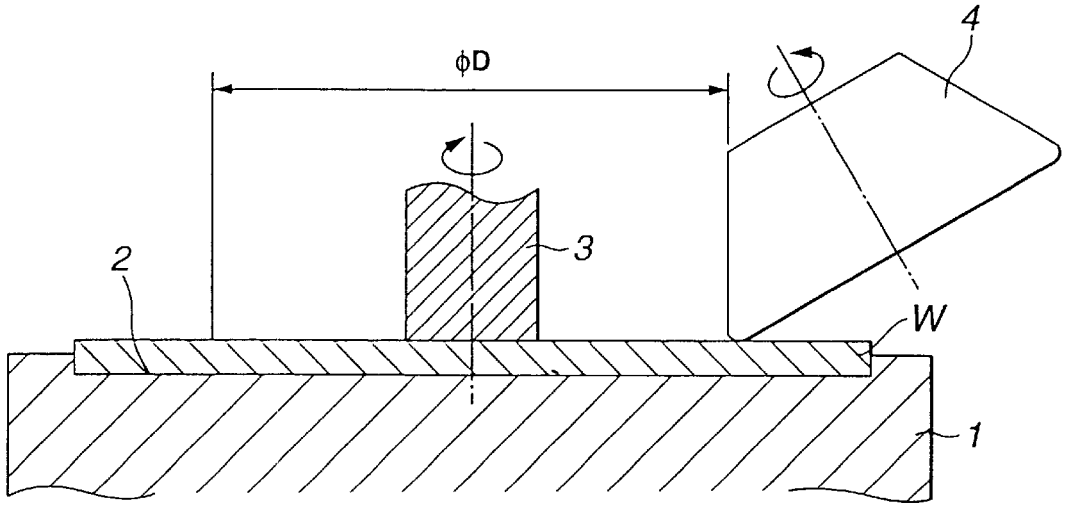
FIG. 1 is a sectional view of an apparatus which shows a spinning process according to a first embodiment of the present invention, the process being in a condition immediately before start.
Figure 2:
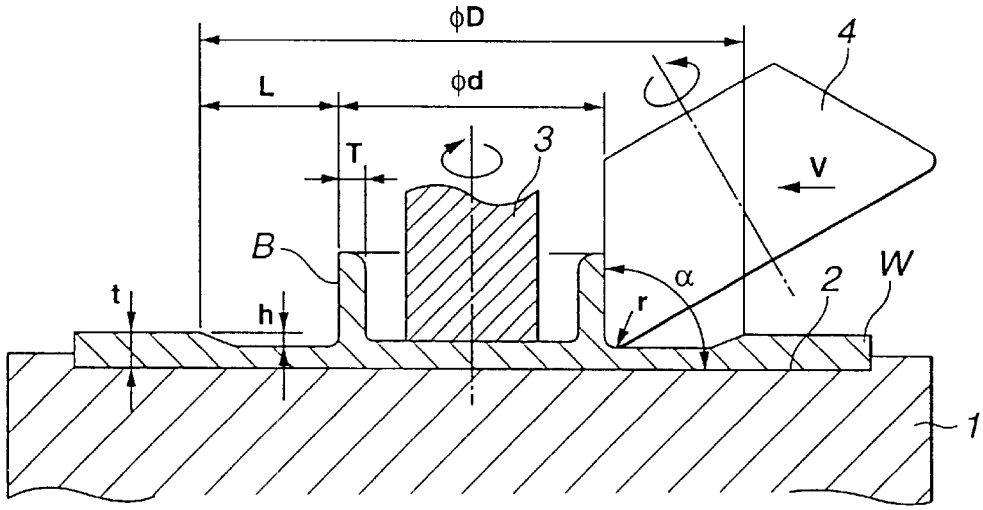
FIG. 2 is a sectional view of the apparatus of FIG. 1 and shows the spinning process in a midway condition.

Referring first to FIGS. 1 and 2, a method for forming boss B in a central part of work W by spinning according to a first embodiment of the present invention will be described. Boss B is in the form of a tubular or hollow cylindrical projection, and work W is a blanked, flat circular steel plate.

In FIG. 1, a mandrel is indicated by 1 and formed with recess 2 for receiving therein work W. Work W is disposed in recess 2 and fixedly held by tail stock 3 which pushes the central portion of work W against mandrel 1. Work W is driven to rotate about a center axis thereof together with mandrel 1 and tail stock 2, i.e., in a way as to be held positioned on a plane. Since in this embodiment work W is in the form of a simple, flat circular plate, work W serves in its entirety as a flat plate portion to be formed with boss B.

Forming roller 4 used for shear spinning is solid and in the form of a truncated cone. Forming roller 4 is disposed so as to have an axis of rotation which is inclined to form a predetermined angle with the axis of work W. However, a conical forming surface of forming roller 4 is constructed and arranged so as to be nearly parallel to the axis of work W at a surface portion nearest to the same.

Forming roller 4 is pushed against work W which is being driven to rotate and is moved at a constant speed toward the axis of work W to decrease the thickness of work W. In this instance, forming roller 4 for shear spinning is not necessarily single but two or more of forming rollers 4 can be used so long as the points where rollers 4 are brought into contact with work W are located in the same circle about the axis of rotation of work W.

The movement of forming roller 4 causes work W to partially decrease in thickness for thereby causing the material of work W to be collected partially and gradually at a central portion of work W to protrude axially and grow to boss B in the form of a tubular projection as shown in FIG. 2. Namely, the movement of forming roller 4 causes a section of work W to decrease in thickness and another section of work W, which is located nearer to the axis of rotation of same, to increase in thickness and grow to boss B.

In this instance, when the above described spinning is carried out so as to meet the working conditions or requirements described herein below, boss B having a smooth inner circumferential surface and constant in thickness can be formed though the inner circumferential side of the boss is not restrained by tail stock 3. Accordingly, boss B having a good concentricity of the inner and outer circumferential surfaces and an accurate, hollow cylindrical shape can be formed.

The above described working conditions will now be described. As shown in FIG. 2, assuming that t is a thickness of work W, h is a depth by which forming roller 4 cuts into work W, D is a diameter of a circle including a point where forming or spinning by forming roller 4 starts, d is the outer diameter of boss B, T is a thickness of a wall of boss B, $\alpha$ is an angle which forming roller 4 forms with work W (i.e., the angle which the forming surface portion of forming roller 4 which is located nearest to the axis of work W, forms with a side surface of the work W when observed in a section taken along a plane including the axis of rotation of work W and an axis of forming roller 4), and V is a volume of boss B, it is preferable to carry out the above described forming of boss B so as to meet the following conditions:

(1) h=0.5t or smaller, preferably from 0.1 to 0.4t;

(2) d=0.25 to 0.94D (3) T=7h or smaller, more specifically from 0.5 to 7h;

(4) V=0.029 to $0.234\pi D^2h$;

(5) r=0.1 to 0.75t; and (6) $\alpha$=85 to 100 degrees.

Of the above conditions, (1) to (4) are indispensable requirements of the present invention.

Further, thickness T of boss B, depth h, working speed v and radius r of curvature of the tip end of forming roller 4 have the following correlation, and thickness T of boss B can be set optionally. However, a, b, c are coefficients which vary depending upon a variation of material for work W.

$$T=(a\times h)+(b\times v)+(c\times r)$$

The specific working conditions of this embodiment were as follows.

| | |
|---|---|
| Thickness t | t = 6 (mm) |
| Depth h | h = 1.2 (mm) |
| Speed v | v = 1 (mm/rev.) |
| Radius of curvature | r = 1.5 (mm) |
| Diameter D | D = 180 (mm) |
| Distance L (L = (D-d)/2) | L = 58.5 (mm) |
| Diameter d | d = 63 (mm) |
| Thickness T | T = 5 (mm) |
| Volume V | V ≈ 26000 ($mm^3$) |

Figure 3:
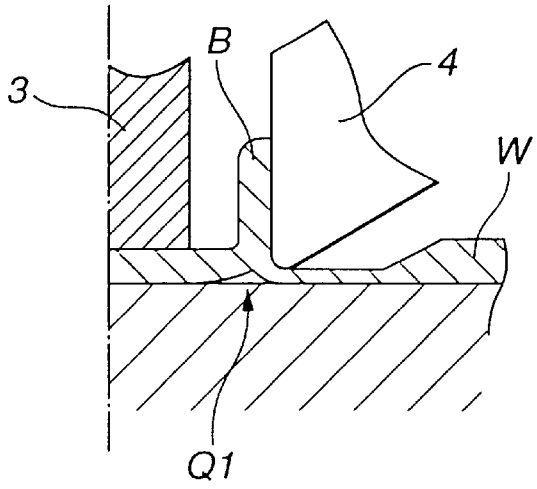
FIG. 3 is a fragmentary sectional view of the apparatus of FIG. 1 and shows a defect caused in a formed part in case a process requirement is not satisfied.
Figure 4:
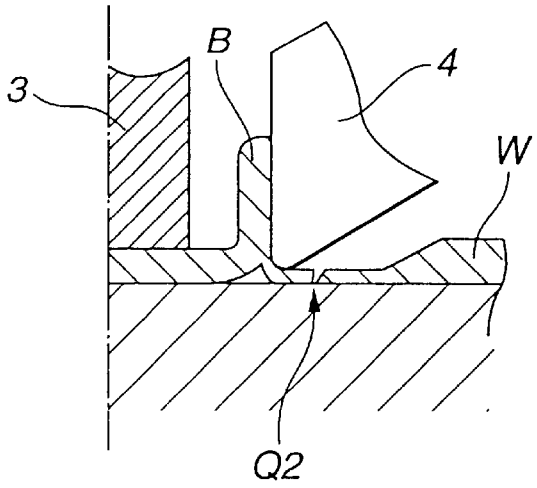
FIG. 4 is a view similar to FIG. 3 but shows another defect caused in a formed part in case another process requirement is not satisfied.
Figure 5:
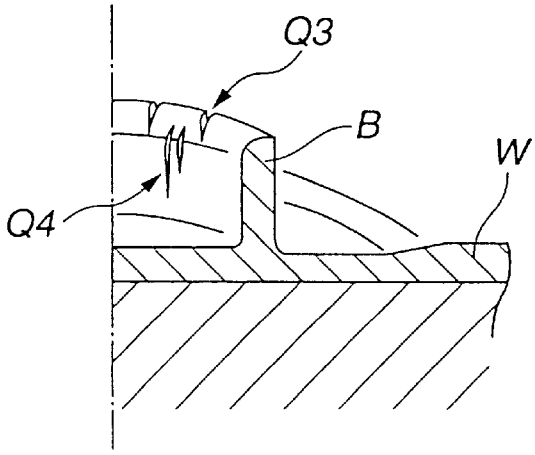
FIG. 5 is a view similar to FIG. 3 but shows a further defect caused in a formed part in case a further process requirement is not satisfied.

FIGS. 3 to 5 illustrate how a defect in forming occurs when either of the above described working conditions deviates from a required range. For example, when depth h by which forming roller 4 cuts into work W exceeds 0.5t, a defect is caused as shown in FIG. 3, i.e., the rear surface of work W is partially elevated at a corresponding position to the root of boss B to cause portion Q1 which is excessively decreased in thickness, or a defect is caused as shown in FIG. 4, i.e., there occurs a break in a flat portion of work W, which has been decreased in thickness. It is considered that these defects are caused for the reason that the thickness of work W was decreased excessively to such an extent as to cause plastic flow of work W itself to reach to the limit.

Further, in case outer diameter d of boss B is smaller than 0.25D, break Q3 or fissure Q4 is caused at the end portion or the circumferential wall portion of boss B as shown in FIG. 5. It is considered that such break or fissure is caused due to the insufficiency of the material necessary for the growth of boss B. It was found that in case outer diameter d of boss B exceeded 0.94D an excess amount of material tended to be supplied to boss B side to disable boss B from maintaining a desired tubular shape.

Figure 6:
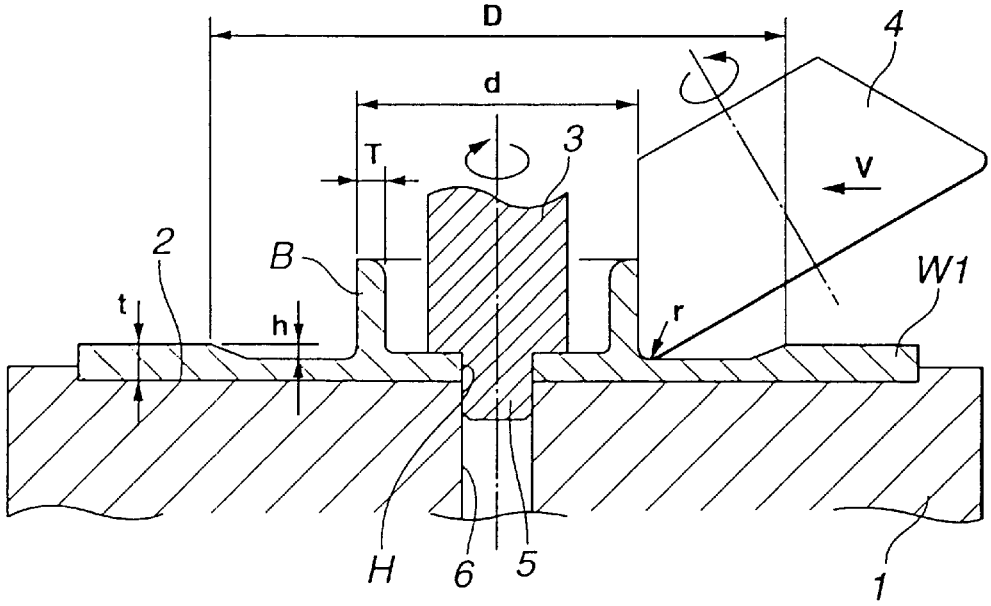
FIG. 6 is a view similar to FIG. 2 but shows a spinning process according to a second embodiment of the present invention, the process being in a midway condition.

FIG. 6 shows a second embodiment of the present invention. In the second embodiment shown in FIG. 6, work W1 is previously formed with prepared hole H at the central portion thereof. Tail stock 3 is formed with reduced diameter portion 5 which extends through prepared hole H. Mandrel 1 is formed with positioning hole 6 for receiving reduced diameter portion 5. By the above structure, work W1 is positioned by two kinds of engagement, i.e., engagement of the outer cylindrical surface of work W1 in recess 2 and engagement of prepared hole H with reduced diameter portion 5 of tail stock 3.

Figure 7:
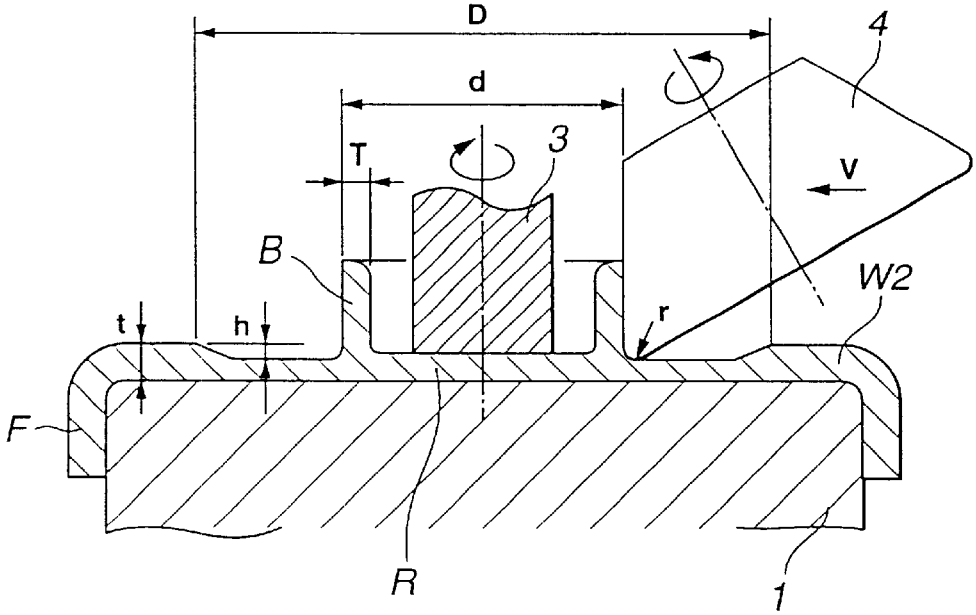
FIG. 7 is a view similar to FIG. 2 but shows a spinning process according to a third embodiment of the present invention, the process being in a midway condition.

FIG. 7 shows a third embodiment. This embodiment is substantially similar to the first embodiment except that work W2 is previously formed with axially flanged outer peripheral end portion F and boss B is formed at flat portion R other than flanged outer peripheral end portion F.

The second and third embodiments can produce substantially the same effect as the first embodiment.

Figure 8:
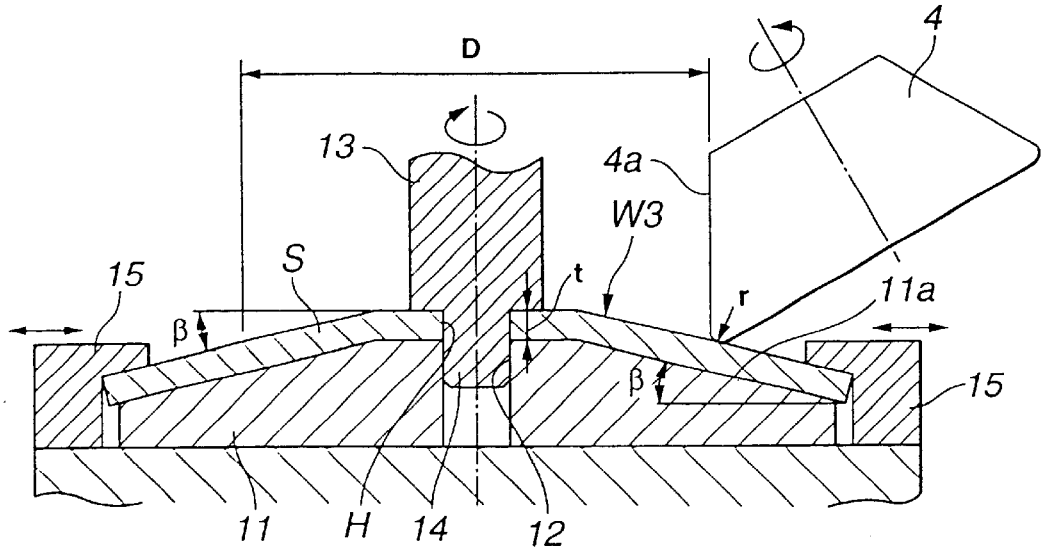
FIG. 8 is a sectional view of an apparatus which shows a spinning process according to a fourth embodiment of the present invention, the process being in a condition immediately before start.
Figure 9:
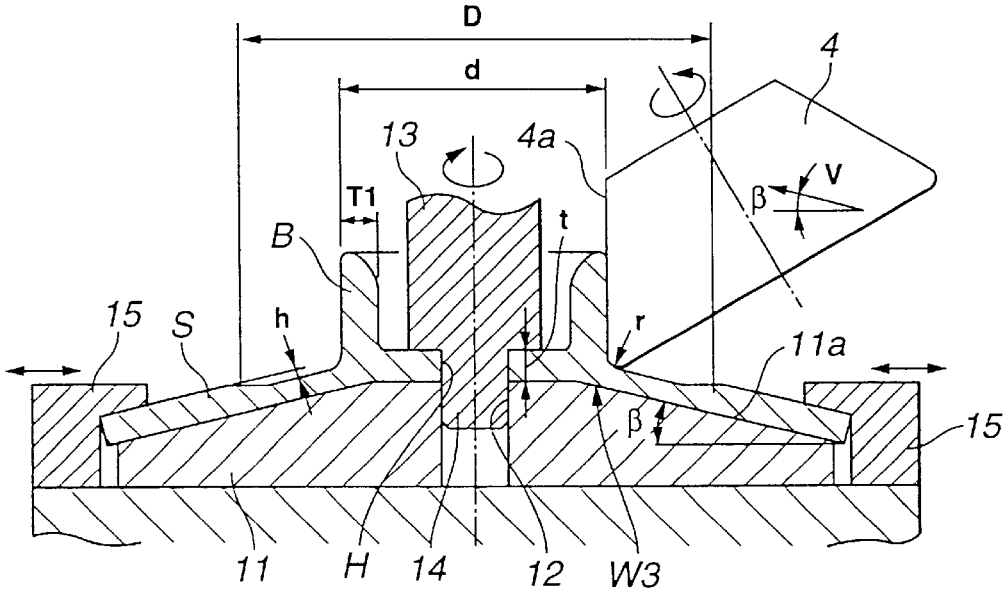
FIG. 9 is a sectional view of the apparatus of FIG. 8 and shows the spinning process in a midway condition.

FIGS. 8 and 9 show a fourth embodiment. This embodiment is substantially similar to the previous embodiments except that work W3 is previously formed into a shallow dish shape so that a portion of work W3 other than the flat central portion at which boss B is to be formed, is formed into inclined wall portion S which inclines at predetermined angle β.

More specifically, work W3 is formed at the flat central portion thereof with prepared hole H by press forming or the like and at the same time the portion of work W3 other than the central portion at which boss B in the form of a projection is to be formed, is previously processed by press forming or spinning so as to incline or taper at predetermined angle β and be thereby formed into inclined or tapered wall portion S such that work W1 is generally formed into a shallow dish shape.

On the other hand, mandrel 11 for supporting work W1 is formed with support surface 11*a* corresponding in shape to inclined wall portion S and positioning hole 12 at the central part thereof. Tail stock 13 for pushing work W3 against mandrel 11 and thereby holding it fixedly, is formed with reduced diameter portion 14 that fits in prepared hole H. Work W3 is disposed so as to cover mandrel 11, i.e., so as to bring inclined wall portion S into contact with support surface 11*a*. Under this condition, the peripheral portion of work W3 is clamped by chuck 15 and at the same time tail stock 13 with reduced diameter portion 14 fitted in prepared hole H is pushed with a predetermined pressure for thereby fixedly holding the central portion of work W3 while positioning the same by the effect of engagement of reduced diameter portion 14 with prepared hole H. In this instance, it is preferable to set inclination β of inclined wall portion S of work W1 and support surface 11*a* of mandrel 11, i.e., inclination β of inclined wall portion S when viewed in section taken along a plane including a center axis thereof, at a value ranging from 5 to 40 degrees.

Forming roller 4 used in this embodiment is solid and truncated cone-shaped similarly to those of the previous embodiments. Forming roller 4 has an axis of rotation which is inclined to form a predetermined angle with the axis of work W3. Forming roller 4 is constructed and arranged so as to have, when observed in section taken along a plane including the axis of rotation of tail stock 13 and the axis of rotation of forming roller 4, a surface portion 4*a* which is nearest to the axis of rotation of tail stock 13 and which is always held nearly parallel with the axis of rotation of work W3.

The process steps for forming boss B are as follows. Firstly, under the condition where work W3 is rotating together with mandrel 11, forming roller 4 is pushed against inclined wall portion S of work W3 and moved along inclination β of work W3 toward the center of same, i.e., from a lower side of inclined wall portion S to a higher side at predetermined speed v in order to decrease the thickness of work W3. In this instance, similarly to the first embodiment, forming roller 4 for spinning is not necessarily single but two or more of rollers 4 can be used so long as contact portions of rollers 4 in contact with work W3 are located on the same circle around the axis of rotation of work W3. However, radius r of curvature of the tip end of forming roller 4 and speed v of movement of forming roller 4 are basically the same as that of the first embodiment.

By this, a process for decreasing and increasing the thickness of work W3 having inclined wall S is carried out. Namely, movement of forming roller 4 causes work W3 to partially decrease in thickness to allow the material of work W3 to be collected gradually at the central portion of work W3, thus causing the central portion of work W3 to protrude and grow to boss B in the form of a hollow, cylindrical projection. In other words, movement of forming roller 4 causes a section of inclined wall portion S of work W3 to decrease in thickness and a section of work W3 at or adjacent the flat central portion thereof to increase in thickness to protrude and grow to boss B.

In this instance, although boss B is not restrained at the inner circumferential surface side thereof by tail stock 13, it can have a smooth cylindrical surface while being uniform in thickness T similarly to the previous embodiment, thus making it possible to obtain boss B which has an accurate concentricity of the inner and outer circumferential surfaces and an accurate hollow cylindrical shape.

Figure 10:
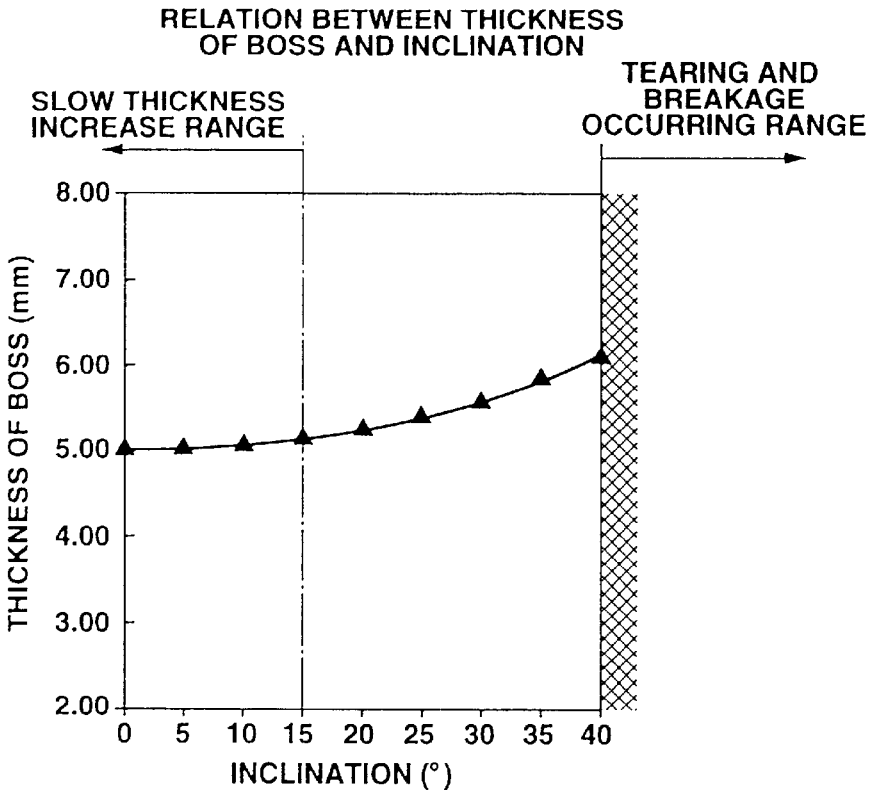
FIG. 10 is a graph of a relation between a thickness of a boss and an inclination of an inclined wall portion of a part produced by the process according to the fourth embodiment.

By varying inclination β of inclined wall portion S of disk-shaped work W3, an influence of inclination β on thickness T1 of boss B was examined. FIG. 10 shows the result of examination. From this examination, it was understood that even if depth h by which forming roller 4 cut into work W3 was constantly 1.2 mm thickness T1 of formed boss B increased with increase of inclination β of inclined wall S. In the meantime, in the graph of FIG. 10, inclination of 0 degree corresponds to the forming processes of the first and second embodiments.

Figure 11:
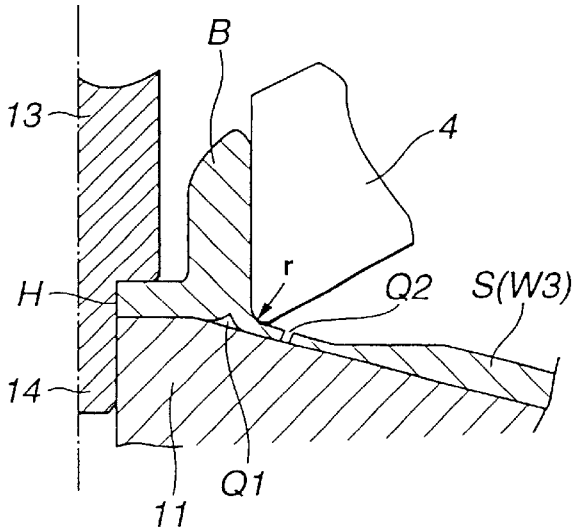
FIG. 11 is a fragmentary sectional view of the apparatus of FIG. 8 and shows a defect caused in a formed part in case a process requirement is not satisfied.

However, as will be apparent from FIG. 10, when inclination β is smaller than 15 degrees, thickness increase is slow. On the other hand, when inclination β exceeds 40 degrees or in case radius of curvature r of the tip end of forming roller 4 is too small or depth h by which forming roller 4 cuts into work W3 is too large, depression Q1 is caused at the base of boss B due to partial elevation of work W3 as shown in FIG. 11 or tearing Q2 is caused at inclined wall portion S which is partially decreased in thickness excessively. It is considered that such depression Q1 and tearing Q2 are caused for the reason that the thickness of work W3 is decreased excessively to such an extent as to cause plastic flow of work W3 itself to reach to the limit. Accordingly, it is preferable that inclination β ranges from 5 to 40 degrees and it is most preferable that inclination β ranges from 15 to 35 degrees. It was found that even if depth h in this embodiment, by which forming roller 4 cut into work W1 was substantially equal to that in the first and second embodiments, thickness T1 of boss B could be 1.1 to 1.3 times larger as compared with that in the first and second embodiments.

Figure 12:
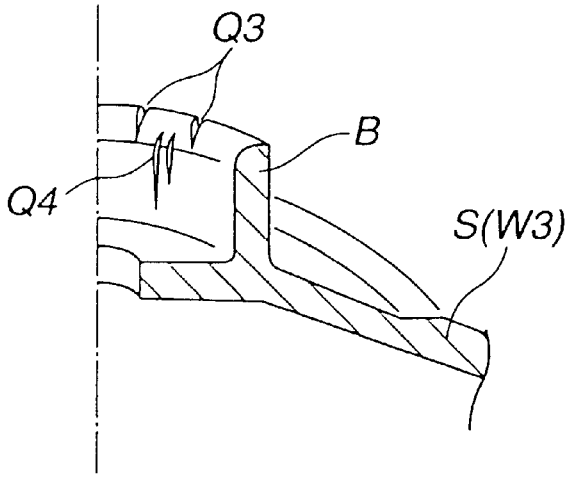
FIG. 12 is a perspective, partly cutaway view of a formed part which is formed by the process according to the fourth embodiment and shows a further defect caused in a formed part in case a further process requirement is not satisfied.

Further, if supply or movement of material to an area where boss B is to be formed is insufficient, break Q3 or fissure Q4 is caused as shown in FIG. 12. Further, in case radius r of curvature of the tip end of forming roller 4 is too large, movement of the material caused by decrease in thickness of work W3 neither causes a portion of the material to bifurcate from inclined wall portion S nor grow to boss B but causes inclined wall portion S to be partially elevated as shown in FIG. 13.

Figure 14:
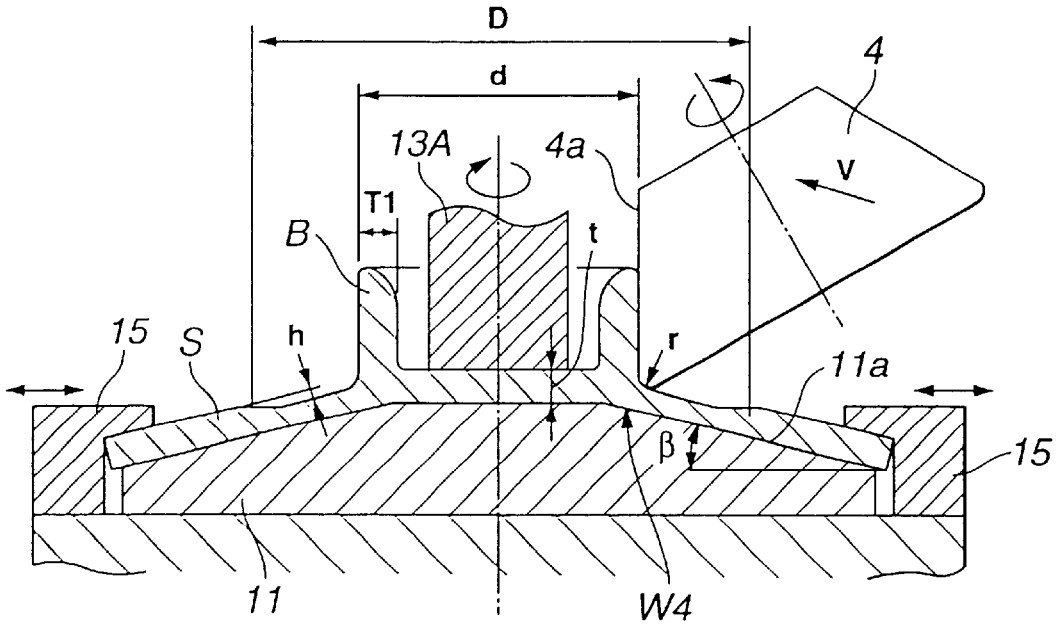
FIG. 14 is a view similar to FIG. 9 but shows a spinning process according to a fifth embodiment of the present invention, the process being in a midway condition.

FIG. 14 shows a fifth embodiment of the present invention. This embodiment differs from the fourth embodiment in that tail stock 14 is not adapted to penetrate through work W4 but simply pushes work W4 against mandrel 11 to hold it fixedly. Except for the above, this embodiment is substantially similar to the fourth embodiment and can produce substantially the same effect.

Figure 13:
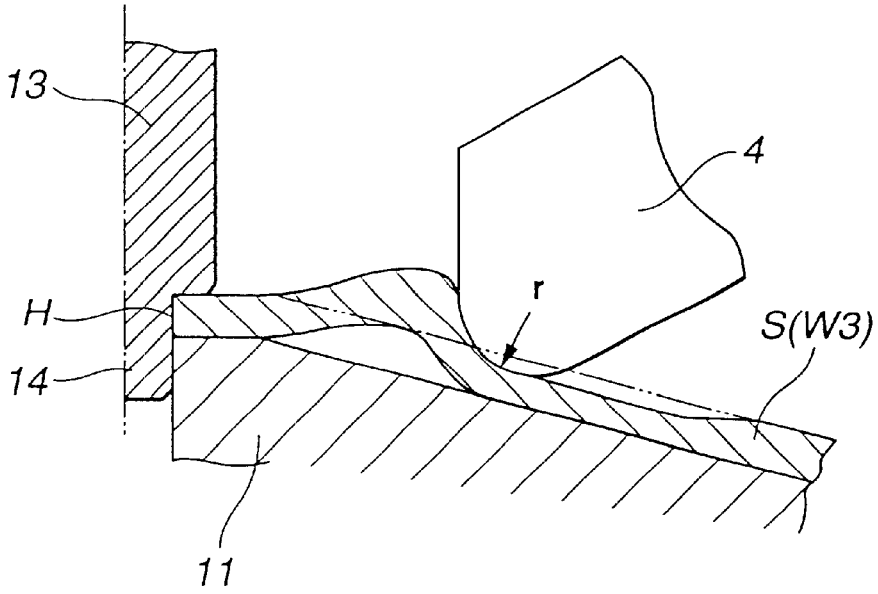
FIG. 13 is a view similar to FIG. 11 buts shows another defect caused in a formed part in case another process requirement is not satisfied.
Figure 15:
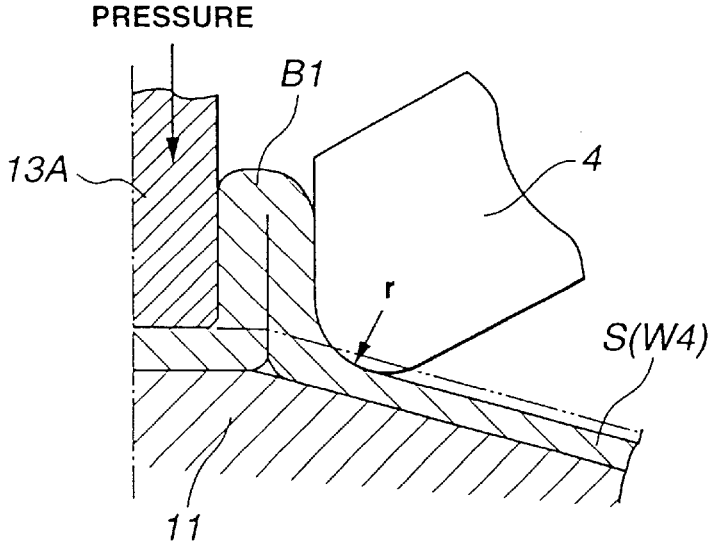
FIG. 15 is a fragmentary sectional view of an apparatus which shows a spinning process according to a sixth embodiment of the present invention.

In the fifth embodiment, by utilizing the phenomenon shown in FIG. 13 positively, i.e., the phenomenon of elevation of inclined wall portion S positively, it becomes possible, as shown in FIG. 15, to form boss B1 of a large thickness by controlling the pressure of tail stock 13A and thereby the amount of elevation of inclined wall portion S of work W4 to finally fold the elevated part of inclined wall portion S into two. However, in this instance, in order to form boss B1 which is accurate particularly in the inner diameter, it is necessary to restrain the inner circumferential side of boss B1 by tail stock 13A, differing from the previous embodiments.

Figure 16:
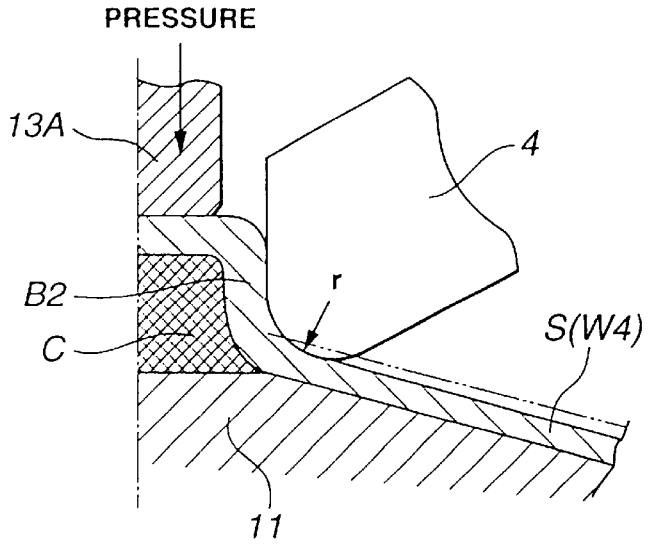
FIG. 16 is a fragmentary sectional view of an apparatus which shows a spinning process according to a seventh embodiment of the present invention.

Similarly, as shown in FIG. 16, by decreasing the pressure gradually or stepwise as the elevated part of inclined wall portion S grows, boss B2 having a desired shape can be formed even if there does not exist at least any portion of mandrel 11 in the space inside boss B2 (i.e., cross hatched portion C).

Figure 17:
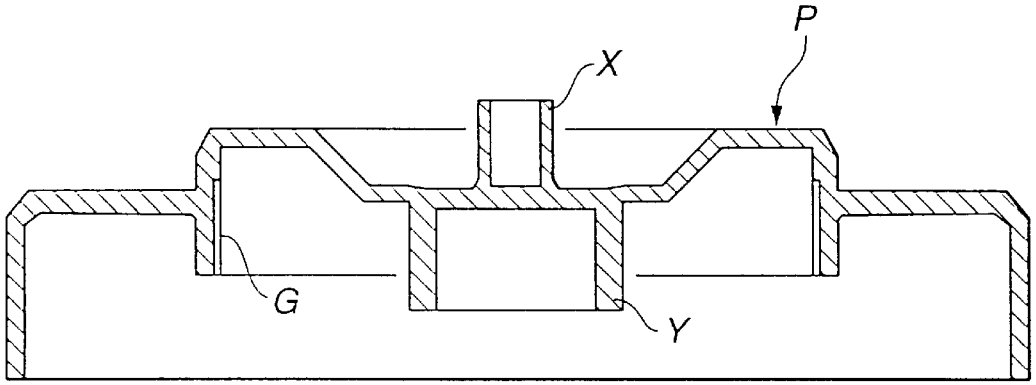
FIG. 17 is a sectional view of a part which is formed by the process according to the present invention.

FIG. 17 shows an example of product P which can be formed by repeating the above described spinning processes for causing a section of a work to increase in thickness for several times. This kind of product P of a complicated shape can be formed from a single disk-shaped work, provided that the above described working conditions are satisfied. In the meantime, indicated by G in the figure is an internal gear which may be a splined or serrated gear. The internal gear is formed by first carrying out the above described spinning process for increase in thickness and thereafter a shear spinning process. Further, the portions indicated by X and Y are formed by first carrying out the above described spinning process for increase in thickness and then shear spinning for forming the outer circumferential shape and further by carrying out shear spinning for finishing the inner circumferential shape. In the meantime, the finishing for the inner circumferential shape can be made by machining in place of shear spinning.

The entire contents of Japanese Patent Applications P2000-69945 (filed Mar. 14, 2000) and P2000-355288 (filed Nov. 22, 2000) are incorporated herein by reference.

Although the invention has been described above by reference to certain embodiments of the invention, the invention is not limited to the embodiments described above. Modifications and variations of the embodiments described above will occur to those skilled in the art, in light of the above teachings. For example, the work is not limited to those described above but can have various shapes, provided that it has a flat portion at which a projection is to be formed. Further, the projection to be formed by spinning is not limited to a hollow cylindrical shape but can be various shapes such as a conical shape. Further, the projection is not always required to be positioned concentrically but can be formed eccentrically by driving the work about an eccentric axis. The scope of the invention is defined with reference to the following claims.

What is claimed is:

1. A method of forming an integral tubular projection in a disk-shaped work by spinning, the work having a flat plate portion, the method comprising:

driving the work to rotate in such a manner that the flat plate portion is held positioned on a plane; and spinning the work by using a forming roller whose axis is inclined to form a predetermined angle with an axis of rotation of the work, in such a manner as to cause a section of the work to decrease in thickness and another section of the work to increase in thickness and grow to the tubular projection;

wherein:

$h=0.1$ to $0.5t$;

$d=0.25$ to $0.94D$ $T=0.5$ to $7h$; and $V=0.029$ to $0.234\pi D^2h$ where h is a depth by which the forming roller cuts into the work, t is a thickness of the work, d is an outer diameter of the tubular projection, D is a diameter of a circle including a point where the spinning by the forming roller starts, T is a thickness of a wall of the tubular projection, and V is a volume of the tubular projection.

2. The method according to claim 1, wherein the projection is hollow cylindrical, and an inner circumferential surface of the projection is held unrestraint during the time from start to completion of forming of the projection.

3. The method according to claim 1, wherein the work is driven about an axis thereof and the projection is formed concentric with the work.

4. A method of forming an integral tubular projection in a disk-shaped work by spinning, comprising:

forming the work into a shallow dish shape, the shallow dish-shaped work having a central portion where the projection is to be formed and an inclined wall portion surrounding the central portion;

supporting the shallow dish-shaped work on a mandrel which is shaped correspondingly to the shallow dish-shaped work;

driving the shallow dish-shaped work to rotate about an axis thereof together with the mandrel; and pushing a forming roller against the inclined wall portion of the work while moving the roller along the inclined wall portion and thereby causing the inclined wall portion to partially decrease in thickness and the central portion to partially increase in thickness and grow to the tubular projection;

wherein an inclination of the inclined wall portion of the work ranges from 5 to 40 degrees.

5. The method according to claim 4, wherein the inclination of the inclined wall portion of the work ranges from 15 to 35 degrees.

6. The method according to claim 4, wherein the forming roller has a forming surface portion which is parallel to the axis of the work when observed in a section taken along a plane including the axis of the work and the axis of rotation of the forming roller.

7. A method of forming a circular part having an integral, concentric boss in the form of a hollow cylindrical projection, by spinning, comprising:

preparing a circular work;

holding the work between a mandrel and a tail stock and driving the work to rotate; and pushing a forming roller against the work and moving the forming roller toward an axis of rotation of the work, and thereby causing a radially outer section of the work to decrease in thickness and a radially inner section of the work to increase in thickness and grow to the boss while holding an inner circumferential surface of the boss apart from an outer circumferential surface of the tail stock;

wherein the work is a flat circular plate without any prepared hole, the mandrel having a circular recess for positioning the work in place thereon.

8. A method according to claim 7, wherein:

h=0.1 to 0.5t;

d=0.25 to 0.94D;

T=0.5 to 7h; and $V=0.029$ to $0.234\pi D^2h$ where h is a depth by which the forming roller cuts into the work, t is a thickness of the work, d is an outer diameter of the boss, D is a diameter of a circle including a point where the spinning by the forming roller starts, T is a thickness of a wall of the boss, and V is a volume of the boss.

9. A product produced a method of forming a circular part having an integral, concentric boss in the form of a hollow cylindrical projection, by spinning, comprising:

preparing a circular work;

holding the work between a mandrel and a tail stock and driving the work to rotate; and pushing a forming roller against the work and moving the forming roller toward an axis of rotation of the work, and thereby causing a radially outer section of the work to decrease in thickness and a radially inner section of the work to increase in thickness and grow to the boss while holding an inner circumferential surface of the boss apart from an outer circumferential surface of the tail stock;

wherein the work is a flat circular plate without any prepared hole, the mandrel having a circular recess for positioning the work in place thereon.

10. A method according to claim 7, wherein the work is a flat circular plate with a concentric prepared hole, the mandrel having a concentric hole, the tail stock having a reduced diameter portion engageable with the concentric hole and the prepared hole of the work for positioning the work in place on the mandrel.

11. A product produced by a method of forming an integral tubular projection in a disk-shaped work by spinning, the method comprising:

forming the work into a shallow dish shape, the shallow dish-shaped work having a central portion where the projection is to be formed and an inclined wall portion surrounding the central portion;

supporting the shallow dish-shaped work on a mandrel which is shaped correspondingly to the shallow dish-shaped work;

driving the shallow dish-shaped work to rotate about an axis thereof together with the mandrel; and pushing a forming roller against the inclined wall portion of the work while moving the roller along the inclined wall portion and thereby causing the inclined wall portion to partially decrease in thickness and the central portion to partially increase in thickness and grow to the tubular projection;

wherein an inclination of the inclined wall portion of the work ranges from 5 to 40 degrees.

12. A method according to claim 7, wherein the work is shallow dish-shaped and has a flat central portion and an inclined wall portion around the central portion, the boss being formed at and adjacent the central portion.

13. A method according to claim 12, wherein an inclination of the inclined wall portion when observed in a section taken along a plane including the axis of rotation of the work ranges from 5 to 40 degrees.

14. A method according to claim 12, wherein the forming roller has a forming surface portion which is parallel to the axis of rotation of the work when observed in a section taken along a plane including the axis of the work and the axis of rotation of the forming roller.

15. A produce produced by a method of forming an integral tubular projection in a disk-shaped work by spinning, the work having a flat plate portion, the method comprising:

driving the work to rotate in such a manner that the flat plate portion is held positioned on a plane; and spinning the work by using a forming roller whose axis is inclined to form a predetermined angle with an axis of rotation of the work, in such a manner as to cause a section of the work to decrease in thickness and another section of the work to increase in thickness and grow to the tubular projection;

wherein:

h=0.1 to 0.5t;

d=0.25 to 0.94D;

T=0.5 to 7h; and $V=0.029$ to $0.234\pi D^2h$ where h is a depth by which the forming roller cuts into the work, t is a thickness of the work, d is an outer diameter of the tubular projection, D is a diameter of a circle including a point where the spinning by the forming roller starts, T is a thickness of a wall of the tubular projection, and V is a volume of the tubular projection.

* * * * *